US005108284A

United States Patent [19]

Gruswitz

[11] Patent Number: 5,108,284

[45] Date of Patent: Apr. 28, 1992

[54] GAS BURNER AND METHOD FOR TUNING SAME

[75] Inventor: Frank A. Gruswitz, Maplewood, Mo.

[73] Assignee: Emerson Electric Co., St. Louis, Mo.

[21] Appl. No.: 576,667

[22] Filed: Aug. 31, 1990

[51] Int. Cl.[5] ..... F23D 14/58

[52] U.S. Cl. ..... 431/286; 431/354; 431/114; 431/346; 431/349; 239/391; 239/552

[58] Field of Search ..... 431/114, 286, 326, 346, 431/349, 354, 191, 355; 29/157 C; 239/552, 558, 391, 424.5, 428.5

[56] References Cited

U.S. PATENT DOCUMENTS

| | | | |
|---|---|---|---|
| 790,714 | 5/1905 | Bray | 239/558 X |
| 1,300,106 | 4/1919 | Armstrong | 239/424.5 X |
| 1,863,100 | 6/1932 | Coleman | 239/552 X |
| 2,121,948 | 6/1938 | Borland | 239/552 X |
| 2,143,128 | 10/1939 | Machlet | 239/552 X |
| 2,177,923 | 4/1965 | Hine, Jr. et al. | 431/286 X |
| 2,514,777 | 7/1950 | Marra | 239/424.5 |
| 2,537,542 | 1/1951 | Norman, Jr. | 239/552 X |
| 2,670,790 | 3/1954 | Marble | 431/286 X |
| 3,058,515 | 10/1962 | Rein et al. . | |
| 3,198,238 | 8/1965 | Hughes | 431/286 X |
| 3,314,610 | 4/1967 | Reznor | 431/286 |
| 3,545,908 | 12/1970 | Lohman | 431/286 |
| 3,684,189 | 8/1972 | Reed et al. | 239/425.5 |
| 3,782,884 | 1/1974 | Shumaker | 431/186 |
| 3,816,062 | 6/1974 | Bouvier | 431/355 |

*Primary Examiner*—Carl D. Price

*Attorney, Agent, or Firm*—Polster, Lieder, Woodruff & Lucchesi

[57] ABSTRACT

An improved inshot gas burner for use in gas furnaces, clothes dryers and other like gas appliances providing improved combustion flame characteristics. A novel burner body design is tuned at manufacture solely by the insertion therein of a flame retention device which has been configured, sized and shaped for the aerodynamic features thereof which will produce proper flame retention and burner fuel loading for the air flow characteristics of the particular appliance model in which the burner will be used. The gas burner is provided with an outwardly flared outlet port downstream of the flame retention device continuous with an outwardly flared diametrically opposed flame carry-over ports. These flared port constructions have produced superior flame characteristics, particularly when used in high-efficiency, forced draft furnaces.

14 Claims, 2 Drawing Sheets

GAS BURNER AND METHOD FOR TUNING SAME

BACKGROUND OF THE INVENTION

The present invention relates to gas burners, and more particularly to inshot gas burners commonly used in gas furnaces, gas clothes dryers and other like gas appliances. The improved gas burner demonstrates particular advantage when utilized in recently developed high-efficiency, forced draft furnaces.

Standard atmospheric furnaces include a gas burner which is provided with a stream of pressurized combustible gas centrally into the inlet opening of the gas burner. The burner is configured with a reduced cross-section venturi which produces a relatively low pressure for aspirating primary combustion air into the burner. The air and gas then enter a slowly expanding mixing chamber. Downstream of the mixing chamber there is positioned a flame retention device having a central port therethrough and a plurality of radially outwardly extending arms defining with the burner body a plurality of circumferentially spaced flame retention ports. The heat produced by these flames rises upwardly through the furnace heat exchanger, thus inducing secondary combustion air to be drawn across the flame to cause further combustion of the gases emanating from the burner ports. This secondary combustion air flows at a relatively slow rate as it is induced into the heat exchanger merely by the force of convection.

It is also known to provide the side-by-side burners in a multi-burner furnace with radially outwardly extending carry-over ports which meet adjacent carry-over ports of adjacent burners to maintain a combustion fuel path for the ignition and re-ignition of one burner to another.

Atmospheric or convection type furnaces as described above normally exhibit a fuel efficiency rating of only about sixty-five to seventy-five percent. Due to recent concerns regarding fuel conservation, the cost of fuel and environmental pollution, manufacturers have developed new high-efficiency furnaces utilizing forced draft heat exchangers. These furnaces include heat exchangers having smaller-diameter, longer and/or more circuitous heat exchanger tubes, and can exhibit efficiency ratings of eighty to ninety percent. These high efficiency heat exchangers can no longer rely on mere convection to induce enough primary and secondary air for proper combustion. Therefore, the designers of such high-efficiency furnaces utilize blowers to induce combustion air into and through the heat exchanger tubes. Further, the designers of high-efficiency furnaces have endeavored to create the smallest possible furnace enclosure for a given furnace heat output. This has led to gas burners of shorter length than previous burners, thus (1) lessening the length of the burner air/gas mixing portion of the burner, (2) changing the burner loading, i.e., resistance to fuel flow through the burner, and (3) changing the aerodynamics of the burner to work in the increased velocity of air flow due to the combustion air blower.

The above enumerated recent changes, and others, in the furnace art have not been accompanied by sufficient gas burner improvements to provide for optimum combustion flame characteristics maintained by the gas burner.

When utilized in high-efficiency, forced draft furnaces, prior art gas burners have exhibited the following deficiencies. They may not ignite properly; they may not have the ability to hold the flame on the flame retention ports; i.e. they may exhibit flame lift off or even blow off, then re-ignite randomly creating a noise problem and contributing to improper combustion; they do not provide reliable flame carry-over performance from one burner to an adjacent burner especially when gas pressure is reduced; they may exhibit the tendency to flash back, i.e., the flame retreats to the pressurized gas source, especially when gas pressure is reduced, and they do not provide for recovery of the flame to its proper position when gas pressure is returned to normal operating pressure; they may provide improper combustion due to excess primary and/or secondary combustion air flow due to the action of the forced draft blower; they show a tendency to burn hard or lean due to excess air and improper loading, and thus produce a greater noise level and poor combustion thereby contributing to air pollution.

Generally, all of the deficiencies enumerated are compounded with the use of propane gas as opposed to natural gas.

Further, due to the wide range of furnace design parameters, such as the air flow characteristics through and surrounding the gas burner maintained by the particular forced air blower, and the size, and configuration of the heat exchanger and even the design of the furnace cabinet, the optimum burner design for one furnace model may not be the best burner design (i.e., not properly tuned), for another furnace model. This presents the problem of excessive tooling costs for producing a myriad of different burner bodies for each different furnace model. The tendency thus far in the industry is to utilize a standard burner whether or not it exhibits properly tuned results for a particular furnace model.

SUMMARY OF THE INVENTION

It is an object of the present invention to produce a gas burner which overcomes all of the deficiencies enumerated above with regard to prior art burners.

More specifically, it is an object of the invention to provide a method for tuning a gas burner, having a single compact burner body design, to the aerodynamic characteristics of a particular furnace model solely by inserting into the burner body at manufacture a flame retention device, the configuration of which has previously been determined to provide desirable flame characteristics for the particular furnace model in which the burner is to be utilized.

It is further object to create an improved gas burner which performs in a superior manner, especially in forced draft furnaces and appliances, to alleviate the conditions of: poor ignition, flame lift off and blow off, poor flame carry-over, flame flash back and poor recovery from flash back, poor combustion with ensuing air pollution, and heightened noise levels.

It is still a further object of the invention to provide a gas burner which will produce all of the advantages set forth above when burning either natural gas or propane gas.

Briefly stated, the gas burner according to the principles of the present invention includes an elongated body defining a passageway therethrough having an inlet opening at one end for the introduction of a pressurized stream of combustible gas and aspirated air. The passageway also includes an outlet opening at the other end for the retention of a combustion flame. Downstream of the inlet opening there is provided a throat or venturi portion having a cross-sectional area less than that of the inlet opening to facilitate the aspiration of primary combustion air into the burner body. The passageway also includes downstream of the venturi a gradually opening expansion and mixing chamber wherein the gas and air are properly mixed for subsequent passage through a flame retention device positioned within a flame retention device chamber formed in the burner body. Downstream of the flame retention device the passageway is provided with an outwardly flared portion. The burner body also includes two diametrically opposed carry-over ports extending radially outwardly from the longitudinal axis of the passageway. These carry-over ports are also flared outwardly along the downstream ends thereof. It has been determined that for best results the outward flare of the carry-over ports and the flare portion of the passageway should be unitarily and continuously formed at an angle from the longitudinal axis of the passageway of between 30° and 55° and preferably between 42° and 45°, and the length of the flared portions should be ⅛" to ⅜" and preferably 3/16" to 5/16".

Generally stated, the gas burner according to the present invention may be tuned solely by inserting into the flame retention device chamber a flame retention device which is configured, sized and shaped for the aerodynamic features thereof to produce proper flame retention and loading of the gas burner for the particular appliance model air flow characteristics without changing the burner passageway body structure or utilizing other burner adjusting mechanisms. The method of tuning a gas burner at manufacture for a particular furnace model characteristics utilizing a standard burner body according to the invention comprises the steps of providing first and second stamped metal plate members which are deformed to define a burner passageway when affixed together. The plate members are deformed to include in the passageway a flame retention device chamber. Prior to affixing the two metal plates together, a flame retention device configuration is chosen which has been shown by experimentation to provide desirable flame characteristics in conjunction with the passageway configuration and the particular furnace model characteristics in which the burner is to be utilized, and which may be retained within the flame retention device chamber. Pursuant to this method there will be provided a precisely permanently tuned gas burner for a particular furnace model without changing the burner stamped metal plate body and without the necessity of any additional burner adjusting means.

BRIEF DESCRIPTION OF THE DRAWINGS

These as well as other objects and advantages of the present invention will become more apparent from a reading of the following detailed description of the preferred embodiments thereof in conjunction with the accompanying drawings, wherein.

DETAILED DESCRIPTION OF THE PREFERRED EMBODIMENTS

Figure 1:
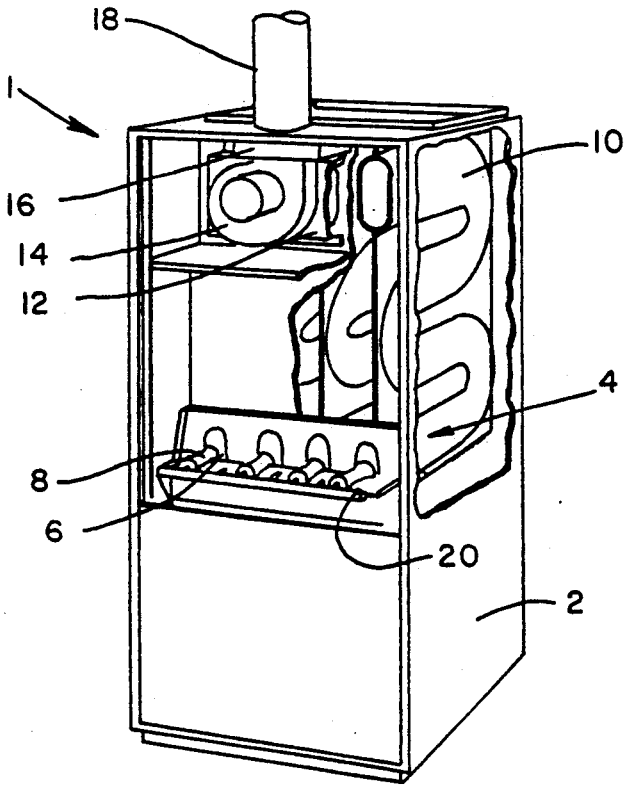
FIG. 1. PRIOR ART.
FIG. 1 is a perspective view of a prior art forced draft combustion furnace showing the environment of prior art gas burners.

With reference to FIG. 1 there is shown a typical prior art forced draft gas combustion furnace 1 having a housing or cabinet 2 enclosing therewithin heat exchanger assembly 4. In the prior art furnace shown, heat exchanger assembly 4 includes four burner openings 6 which are adapted to supply the hot products of combustion emanating from burners 8 along with secondary air into and through heat exchanger tubes 10, into flue gas collection chamber 12, electrically operated blower 14, flue discharge box 16 and flue pipe 18. Natural or propane gas is supplied to burners 8 through ga supply line 20. It can readily be appreciated that forced draft furnace 1 does not rely on mere convection to induce air into heat exchanger inlets 6. Instead, blower 14 induces a rapid flow of air into inlets 6 through heat exchanger tubes 10 and thence out through flue pipe 18.

Figure 2:
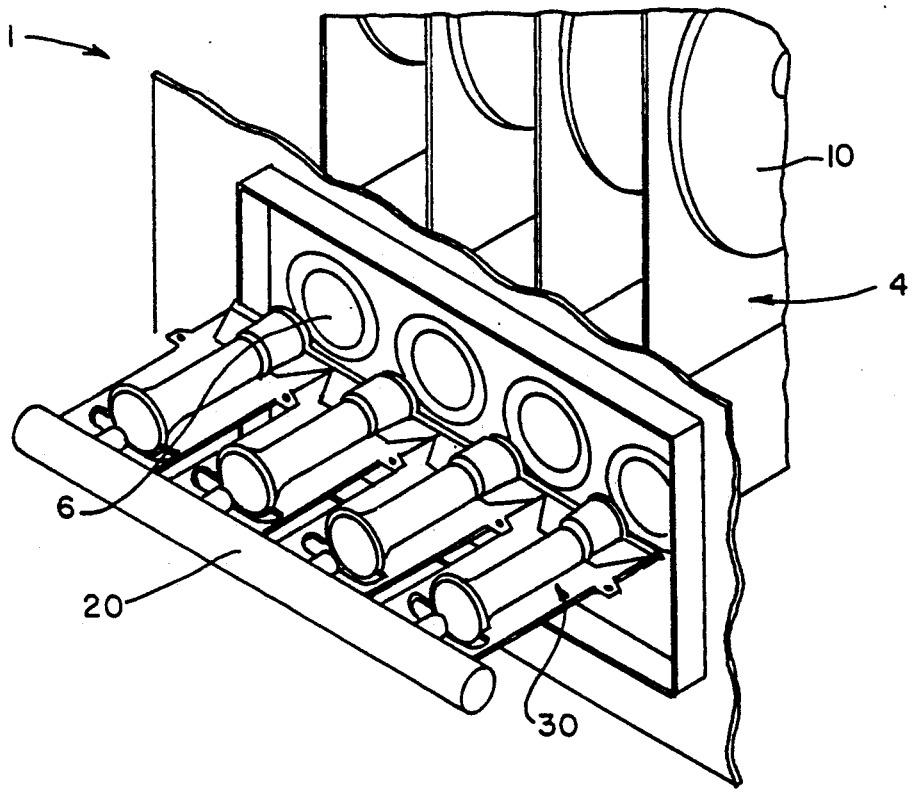
FIG. 2 is an enlarged perspective view of a furnace similar to that of FIG. 1 showing four adjacent gas burners according to the principles of the present invention.
Figure 3:
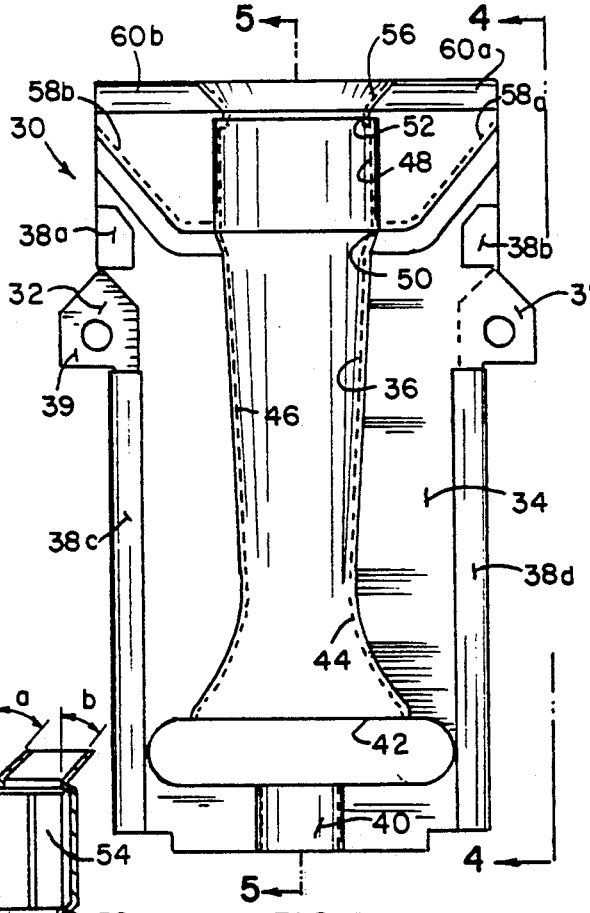
FIG. 3 is a top plan view of a single gas burner according to the present invention.
Figure 4:
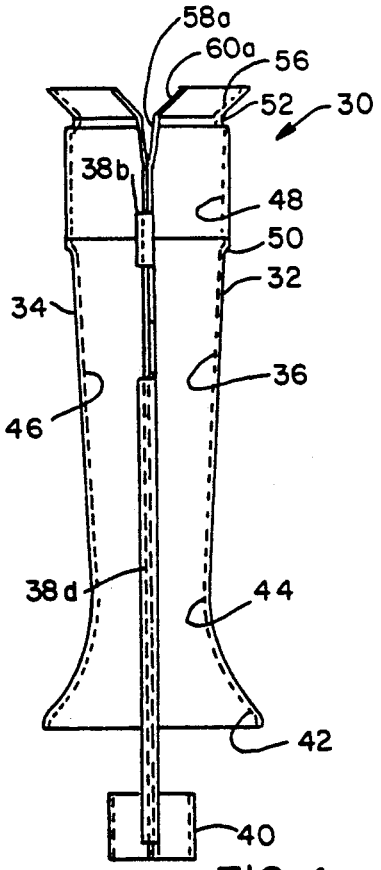
FIG. 4 is a side elevational view of the gas burner as viewed along line 4—4 of FIG. 3.

FIG. 2 shows four adjacently positioned gas burners according to the present invention positioned for operation in front of respective heat exchanger inlets 6. While FIG. 2 is offered to show the general environment in which the burners of the present invention operate, reference is specifically made to FIGS. 3-6 for a detailed description of the burner construction.

Gas burner 30 is comprised of a first stamped metal plate member 32 being deformed to define one half of a gas burner passageway 32*a*, and a second stamped metal plate member 34 being likewise deformed to define the other one half of the gas burner passageway 34*a*. When placed one on top of the other, sheet metal plate members 32 and 34 cooperate to define the gas burner passageway 36 which is formed when metal tab members 38*a*, 38*b*, 38*c* and 38*d* on sheet metal plate member 32 are bent around sheet metal member 34 to permanently engage and hold the two sheet metal members together. Also formed by the mating engagement of members 32 and 34 is gas inlet holder 40 which is coaxially positioned with respect to the central longitudinal axis of passageway 36. Tabs 39 on either side of passageway 36 facilitate the connection of on burner laterally to another identical burner in a known manner.

Figure 5:
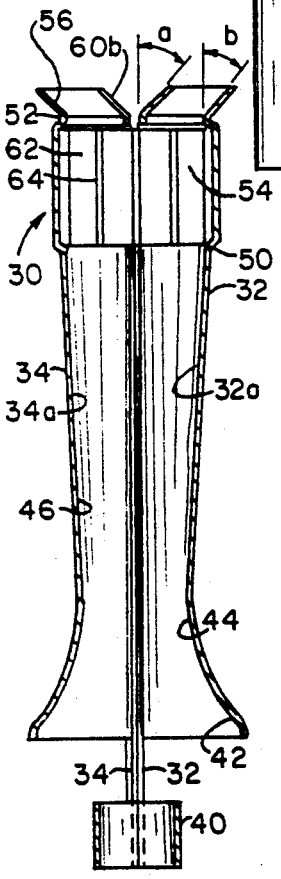
FIG. 5 is a cross-sectional view of the gas burner taken along section line 5—5 of FIG. 3 with a flame retention device shown therein in side elevation.
Figure 6:
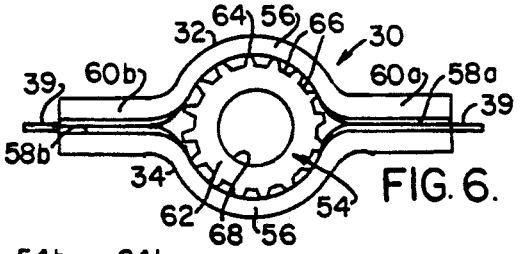
FIG. 6 is an end elevational view of the flame end of the gas burner.

Passageway 36 which is defined by the elongated body formed by plate members 32 and 34 includes an inlet opening 42 at one end thereof for the introduction of a pressurized stream of combustion gas emanating from a gas nozzle (not shown) located on gas supply line 20 and which is located within holder 40. Passageway 36 includes a throat or venturi portion 44 downstream of inlet opening 42 which has a circular cross-sectional area less than the circular cross-sectional area of inlet opening 42 to produce a venturi effect for aspirating primary combustion air into inlet 42. Downstream of throat portion 44 there is provided an expansion and mixing portion 46 which has a gradually increasing circular cross-sectional area toward the downstream direction of passageway 36. Downstream of expansion and mixing portion 46 there is located a flame retention device chamber portion 48 of slightly increased cross-sectional area having upstream indention 50 and downstream indention 52 for the purpose of holding within chamber 48 a flame retention device 54 (FIG. 5). Downstream of flame retention device chamber portion 48 there is provided an outwardly flared portion 56.

Passageway 36 further communicates with two diametrically opposed carry-over ports 58*a* and 58*b* which extend radially outwardly from the longitudinal axis of passageway 36. Carry-over ports 58*a* and 58*b* include outwardly flared portions 60*a* and 60*b* respectively, unitarily and continuously formed with flared portion 56 of passageway 36. For best results, it has been determined through experimentation that the angle "a" and the angle "b" (FIG. 5) between the longitudinal axis of passageway 36 and the outward flare of carry-over ports 60*a*, 60*b* and the angle between the longitudinal axis of passageway 36 and the outward flare of flared portion 56, respectively, should be fabricated between 30° and 55°, optimal results being obtained when angles "a" and "b" are between 42° and 45°. It has also been determined that the length of the flared portions 60*a*, 60*b* and 56 should be ⅛" to ⅜" and for optimal results 3/16" to 5/16". These figures concerning the length of the flared portions are applicable for a burner having a flame retention device of approximately one inch in diameter.

Flame retention device 54 positioned within flame retention device chamber 48 is preferably fabricated of sintered metal and includes generally cylindrical body 62 and a plurality of radially outwardly extending arms or port means 64. Arms 64 cooperate with the interior of flame retention device chamber 48 of passageway 36 to define a plurality of circumferentially spaced flame retention ports 66. A central loading port 68 is positioned longitudinally through cylindrical body 62 of flame retention device 54.

Flame retention device 54 is configured, sized and shaped for the aerodynamic features thereof to produce proper flame retention and loading of the gas burner for a particular appliance model application without changing the burner passageway structure or utilizing other adjusting mechanisms. To this end, there are shown in FIGS. 7–10 alternate configurations for flame retention devices which may be utilized within flame retention device chamber 48 of burner passageway 36.

Flame retention device 54*a*, 54*b*, 54*c* and 54*d* shown respectively in FIGS. 7, 8, 9 and 10 share in common a generally cylindrical body portion 62*a*, 62*b*, 62*c* and 62*d* respectively; a central loading port therethrough 68*a*, 68*b*, 68*c* and 68*d* respectively; a plurality of radially outwardly extending arms 64*a*, 64*b*, 64*c* and 64*d*, respectively. Cylindrical body portions 62*a*, 62*b*, 62*c*, 62*d* all are sized to properly fit within the same flame retention device chamber portion 48 such that the need for redesigning gas burner body of gas burner 30 is eliminated.

Figure 7:
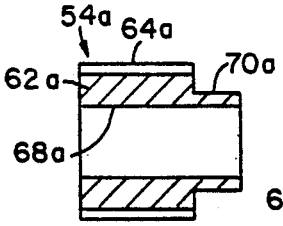
FIG. 7 is a cross-sectional view of an alternative flame retention device which may be utilized in the same gas burner body shown in FIGS. 3-6.

Flame retention device 54*a* shown in FIG. 7 includes a hollow cylindrical extension 70*a* which preferably is fabricated in a unitary manner with retention body 62*a*. Extension 70*a* may be positioned within gas burner body 30 to either protrude outwardly from the flared portion 56 at the outlet end of passageway 36 or positioned upstream of flame retention device chamber 48 depending on the results obtained during experimentation.

Figure 8:
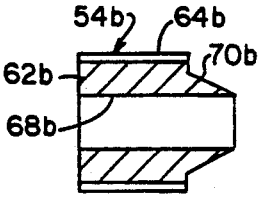
FIG. 8 is a cross-sectional view of another alternative flame retention device.

Flame retention device 54*b* of FIG. 8 includes an aerodynamically tapered extension portion 70*b* which is tapered outwardly from cylindrical body portions 62*b* and which may be positioned either upstream or downstream of radially outwardly extending arms 64*b*.

Figure 9:
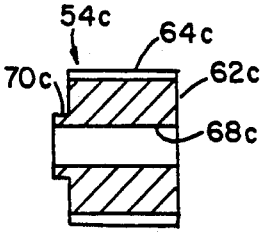
FIG. 9 is a cross-sectional view of still another alternative flame retention device.

Flame retention device 54*c* of FIG. 9 is similar to flame retention device 54*a* of FIG. 7 however it is shown as having a much restricted loading port 68*c* and, for illustration, is positioned to have extension 70*c* in the opposite direction, and extension 70*c* is shown with a much shorter longitudinal dimension than that of extension 70*a*.

Figure 10:
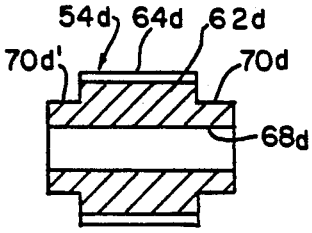
FIG. 10 is a cross-sectional view of still another alternative flame retention device.

Flame retention device 54*d* of FIG. 10 illustrates the alternative embodiment wherein cylindrical body 62*d* is provided with an extension portion 70*d* at one end thereof and another extension portion 70*d'* at the opposite end thereof. According to the flame retention device embodiment of FIG. 10 there will be an extension portion both extending outwardly downstream from radial arms 64*d* past the outlet end of passageway 36 and inwardly upstream into mixing chamber portion 46 of passageway 36. It is noted that either or both of the extension portions 70*d* and 70*d'* may be tapered as illustrated by the extension portion 70*b* of FIG. 8.

The flame retention device configurations shown in FIGS. 5, 7, 8, 9 and 10 are provided for illustrative purposes; it being understood that numerous other retention device configurations are conceivable for the purpose of providing proper flame retention ports and proper gas burner loading, and superior burner aerodynamics. Due to the fact that there are numerous combinations of parameters with regard to any particular furnace model, it can only be determined by experimentation which flame retention device configuration should be chosen for optimal results. According to the principals of the present invention, it is of utmost importance that the flame retention device chosen fits securely within flame retention device chamber 48 of gas burner 30 in order that burner 30 may be tuned to a particular furnace application without the necessity of changing the basic body design.

In operation a pressurized stream of combustible gas is provided through a nozzle located on gas supply line 20 centrally into inlet portion 42 of burner passageway 36. As fluid passes through restricted venturi passage 44 producing a relatively low pressure area, primary combustion air will be aspirated into the burner body through inlet 42 where it is mixed with the gas in air and gas mixing portion 46. The gas/air mixture will tend to expand toward the wall of passageway 36 where it will enter flame retention ports 66 circumferentially spaced around cylindrical body 62 of flame retention device 54. Diameter and length of central loading port 68 will determine the load or back pressure in mixing chamber 46 and the velocity of fuel/air flow through flame ports 66.

Again, this flame retention device design can only be determined by prior experimentation to match the aerodynamic structure of the retention device for a particular appliance aerodynamics. Also it is not precisely known for sure why the flared portion 56 of passageway 36 and the flared portions 60*a* and 60*b* of carry-over ports 58*a* and 58*b*, respectively, operate to provide the advantageous results obtained; however, it is thought that the flared portions aerodynamically configure a portion of the secondary combustion air away from the flame retention ports to in part protect the combustion flames emanating therefrom thereby producing a stable flame front at the flared ports. However, it should be understood that the aerodynamics involved with regard to the primary combustion air being aspirated through passageway 36 and the secondary combustion air being induced by blower 14 around the burner body present a very complicated aerodynamic problem which cannot be fully understood at this time. It can be said that the flared design of burner passageway 36 and the continuous flare of carry-over ports 58*a*, 58*b* in cooperation with the unique flame retention device tuning method disclosed has been shown in the laboratory to produce superior and unexpected results when compared to prior art gas burners. More specifically, the gas burners fabricated according to the principles of the present invention have been shown to ignite in a facile manner when utilized in a forced draft furnace application; have been shown to embody the ability to hold the flame on the flame retention ports, i.e., they do not exhibit flame lift-off or flame blow-off placed under the same conditions as prior art burners; they provide more reliable flame carry-over performance from one burner to an adjacent burner especially when gas pressure is reduced to one third normal delivery pressure; they do not exhibit the tendency to flash back when gas pressure is reduced to one third normal delivery pressure, and when flash back does occur under very low gas pressure delivery, flame recovery has been shown to quickly occur when proper gas pressure is returned; laboratory tests have shown improved combustion when compared to prior art gas burners and due to the improved combustion and superior flame propagation performance rendered by the gas burner of the instant invention, no tendency for the mixture to burn hard or lean due to excess air or improper loading has been observed, and thus a quieter operation is maintained.

It can thus be seen that a gas burner and method of tuning same has been disclosed which accomplishes the many objects and advantages set forth above. Inasmuch as numerous modifications may be made to the preferred embodiments of the invention without departing from the spirit and scope thereof, the scope of the invention is to be determined solely by the recitations of the following claims.

What is claimed is:

1. A gas burner for a forced draft gas appliance comprising:

an elongated body defining within a longitudinal passageway therethrough and having an inlet opening at one end for the introduction of a pressurized stream of combustible gas and aspirated primary air, and an outlet opening at the other end for the retention of a combustion flame;

said passageway including a throat portion, downstream of said inlet opening, having a cross-sectional area less than the cross-sectional area of said inlet opening to produce a venturi;

said passageway including an expansion and mixing portion, downstream of said throat portion, having a gradually increasing cross-sectional area toward said outlet opening;

said passageway including a flame retention device chamber portion, downstream of said expansion and mixing portions;

a flame retention device in said flame retention device chamber portion, and means for maintaining said retention device in said chamber;

said passageway including, downstream of said flame retention device chamber portion, an outwardly flared portion flared away from the longitudinal axis of said body, such that a stream of forced draft secondary air moving longitudinally along the exterior of said body may be deflected by said flared portion in a direction away from the longitudinal axis of said body;

said passageway communicates with two diametrically opposed carry-over ports extending radially outwardly from the longitudinal axis of said passageway;

said carry-over ports being flared outwardly away from the interior thereof along the downstream ends thereof; and said carry-over ports being flared outwardly in substantially the same direction as said flared portion of said passageway such that a stream of forced draft secondary air moving parallel to the longitudinal axis of said body along the exterior of said body may be deflected by the flare of said carry-over ports.

2. The gas burner as specified in claim 1 wherein:

the outward flare of said carry-over ports and said flared portion of said passageway is fabricated at an angle from the longitudinal axis of said passageway of between 30 and 55 degrees and a length of $\frac{1}{8}$ inch to $\frac{3}{8}$ inch.

3. The gas burner as specified in claim 1 wherein:

the outward flare of said carry-over ports and said flared portion of said passageway is fabricated at an angle from the longitudinal axis of said passageway of between 42 and 45 degrees and a length of 3/16 inch to 5/16 inch.

4. The gas burner as specified in claim 1 wherein:

the outward flare of one side of said carry-over ports is unitarily formed with one side of said flared portion of said passageway, and the outward flare of the other side of said carry-over ports is unitarily formed with the other side of said flared portion of said passageway.

5. A gas burner for use in a forced draft gas appliance comprising an elongated longitudinal body defining a passageway therethrough and having an inlet opening at one end for the introduction of a pressurized stream of combustible gas and aspirated primary air, and an outlet opening at the other end for the retention of a combustion flame, a reduced cross-section venturi portion in said passageway for producing a relatively low pressure for aspirating primary combustion air into said passageway, an air and gas mixing portion in said passageway downstream of said venturi portion; a flame retention device means in said passageway downstream of said mixing portion for the retention of the combustion flame and the loading of the air and gas mixture; the improvement comprising:

said passageway including two diametrically opposed carry-over ports extending radially outwardly form the longitudinal axis of said passageway;

said passageway including, downstream of said flame retention device means, an outwardly flared portion flared away from the longitudinal axis of said body, such that a stream of forced draft secondary air moving longitudinally along the exterior of said body may be deflected by said flared portion away from the longitudinal axis of said body; and said carry-over ports being flared at the outlet end thereof outwardly in substantially the same direction as said flared portion of said passageway such that a stream of forced draft secondary air moving parallel to the longitudinal axis of said body along the exterior of said body may be deflected by the flare of said carry-over ports.

6. The gas burner as specified in claim 5 wherein:

said passageway and said carry-over ports being flared outwardly at an angle from the longitudinal axis of said passageway of between 30° and 55°.

7. The gas burner as specified in claim 5 wherein:

said passageway and said carry-over ports being flared outwardly at an angle from the longitudinal axis of said passageway of between 42° and 45° and a length of 3/16 inch to 5/16 inch.

8. A gas burner for use in a gas appliance comprising an elongated body defining a passageway therethrough and having an inlet opening at one end for the introduction of a pressurized stream of combustible gas and aspirated primary air, and an outlet opening at the other end for the retention of a combustion flame, a reduced cross-section venturi portion in said passageway for producing a relatively low pressure for aspirating primary combustion air into said passageway, an air and gas mixing portion in said passageway downstream of said venturi portion, a flame retention device means in said passageway downstream of said mixing portion for the retention of the combustion flame and the loading of the air and gas mixture, said passageway including two diametrically opposed carry-over ports extending radially outwardly from the longitudinal axis of said passageway; the improvement comprising:

said carry-over ports being flared outwardly along the downstream ends thereof.

9. The gas burner as specified in claim 8 wherein:

the outward flare of said carry-over ports being fabricated at an angle from the longitudinal axis of said passageway of between 80° and 55°.

10. The gas burner as specified in claim 8 wherein:

the outward flare of said carry-over ports being fabricated at an angle from the longitudinal axis of said passageway of between 42° and 45° and a length of 3/16 inch to 5/16 inch.

11. A gas burner comprising:

an elongated body formed by two stamped sheet metal plate members defining a passageway therethrough and having an inlet opening at one end for the introduction of a pressurized stream of combustible gas and aspirated air, and an outlet opening at the other end for the retention of a combustion flame;

said passageway including a throat portion, downstream of said inlet opening, having a cross-sectional area less than the cross-sectional area of said inlet opening to produce a venturi;

said passageway including an expansion and mixing portion, downstream of said throat portion, having a gradually increasing cross-sectional area toward said outlet opening;

said passageway including a flame retention device chamber portion, downstream of said expansion and mixing portions;

a flame retention device in said flame retention device chamber portion, and means for maintaining said retention device in said chamber;

said flame retention device including a generally cylindrical body and a plurality of radially outwardly extending arms on said cylindrical body defining with said passageway a plurality of circumferentially spaced flame retention ports, and a central loading port through said cylindrical body, said central loading port being sized and configured to provide aerodynamic tuning of said burner body to a particular forced draft appliance model characteristics in which the burner is to be utilized;

said passageway communicating with two diametrically opposed carry-over ports extending radially outwardly from the longitudinal axis of said passageway;

said passageway and said carry-over ports being unitarily and continuously formed with an outwardly directed flare at said outlet opening.

12. The gas burner as specified in claim 11 wherein:

the outward flare of said carry-over ports and said passageway is fabricated at an angle from the longitudinal axis of said passageway of between 30° and 55°.

13. The gas burner as specified in claim 11 wherein:

the outward flare of said carry-over ports and said passageway is fabricated at an angle from the longitudinal axis of said passageway of between 42° and 45°.

14. A gas burner comprising:

an elongated body defining a passageway therethrough and having an inlet opening at one end for the introduction of a pressurized stream of combustible gas and aspirated air, and an outlet opening at the other end for the retention of a combustion flame;

said passageway including a throat portion, downstream of said inlet opening, having a cross-sectional area less than the cross-sectional area of said inlet opening to produce a venturi;

said passageway including an expansion and mixing portion, downstream of said throat portion, having a gradually increasing cross-sectional area toward said outlet opening;

said passageway including a flame retention device chamber portion, downstream of said expansion and mixing portions;

a flame retention device in said flame retention device chamber portion, and means for maintaining said retention device in said chamber;

said passageway communicating with two diametrically opposed carry-over ports extending radially outwardly from the longitudinal axis of said passageway; and said passageway and said carry-over ports being unitarily and continuously formed with an outwardly directed flare at said outlet opening.

* * * * *